United States Patent [19]

Izzi

[11] 4,067,072

[45] Jan. 10, 1978

[54] PLASTIC DRAIN ASSEMBLY

[76] Inventor: Lewis B. Izzi, 918 Surrey Drive, Shelby, N.C. 28150

[21] Appl. No.: 706,187

[22] Filed: July 21, 1976

[51] Int. Cl.[2] ..... E03C 1/12; E03C 1/26

[52] U.S. Cl. ..... 4/288; 4/292; 285/12; 285/177

[58] Field of Search ..... 4/286, 288, 290, 291, 4/292, 252 R, 252 A; 285/12, 58, 177, 298

[56] References Cited

U.S. PATENT DOCUMENTS

| | | | |
|---|---|---|---|
| 2,311,708 | 2/1943 | Sundholm | 285/177 X |
| 2,749,999 | 6/1956 | Schmid | 285/298 X |
| 2,783,852 | 3/1957 | Sisk | 4/292 X |
| 3,071,781 | 1/1963 | Seewack | 4/286 |
| 3,420,552 | 1/1969 | Mork | 4/288 X |
| 3,742,525 | 7/1973 | Oropallo | 4/288 |
| 3,795,924 | 3/1974 | Kempler | 4/288 X |

*Primary Examiner*—Richard E. Aegerter
*Assistant Examiner*—Stuart S. Levy

[57] ABSTRACT

An interfitting three part plastic drain assembly for use in the floors of shower baths and various types of drains which has a novel interfitting structure enabling it to be used with different sized pipes and to only use two of the parts where no waterproofing membrane is required.

7 Claims, 5 Drawing Figures

FIG. 1
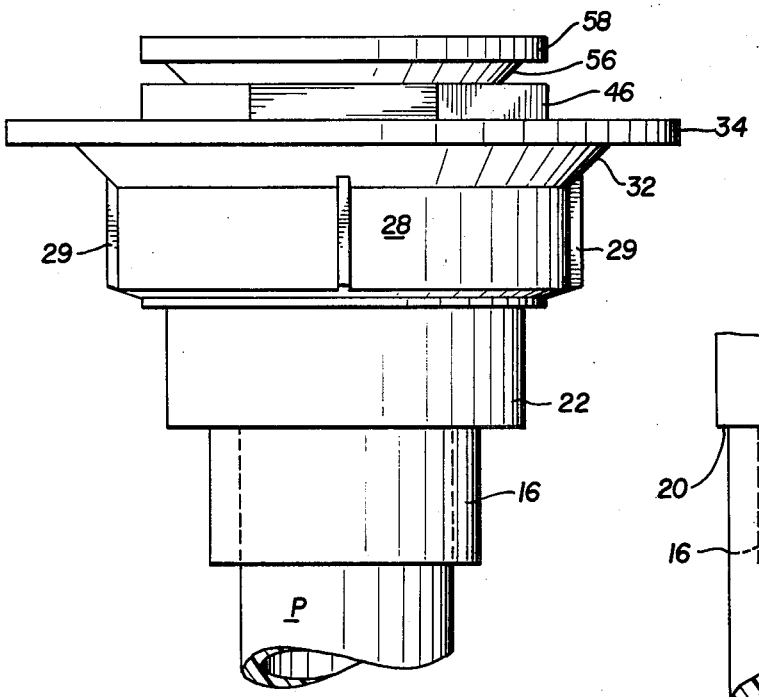
FIG. 2
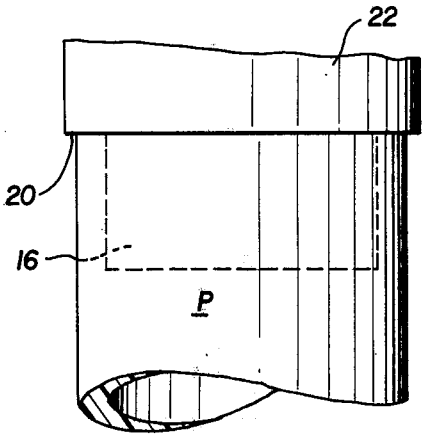
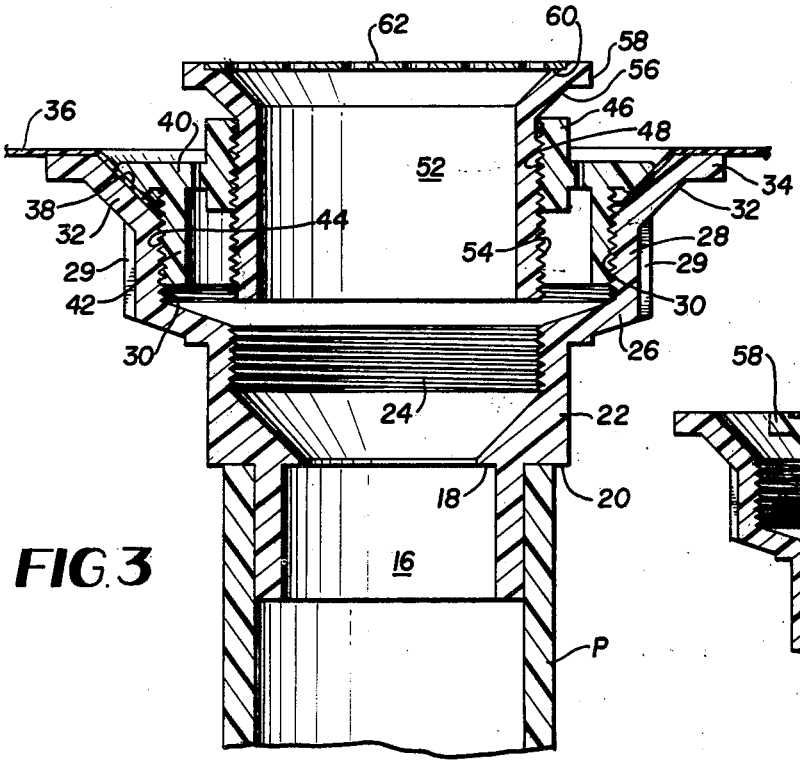
FIG. 3
FIG. 4
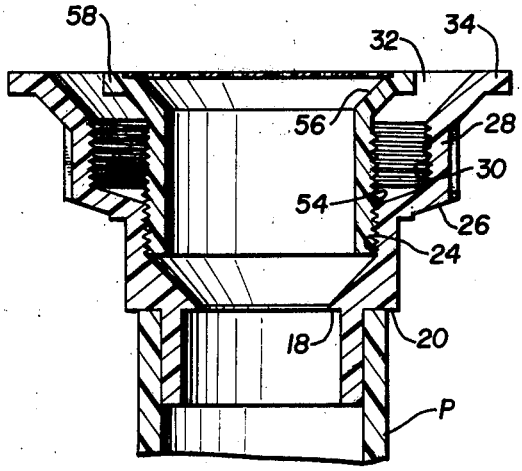

PLASTIC DRAIN ASSEMBLY

The present invention relates generally to drain structures and more particularly to a drain structure assembly formed of plastic having internal surfaces sloped in the direction of flow to allow for greater drainage flow and lessen the possibility of sludge or waste build-up.

As is well known, plumbers and plumbing supply houses must necessarily carry large inventories which need is currently increased by the present day practice of utilizing plastic piping systems alone or in combination with metal pipes where possible. Furthermore, different sizes of drains and pipes must be stocked for the various installations involved.

Accordingly, the main object of the present invention is to provide a plastic drain assembly which requires lower stock inventories.

An important object of the present invention is to provide a novel three part plastic drain assembly wherein each of the three parts is connectible to the other two parts so that a two part plastic drain assembly may be used where a water-proofing membrane is not required.

Another important object of the present invention is to provide a three part plastic drain assembly wherein each part is so threaded that the strainer drain plate may be adjusted to any desired height.

A further important object of the present invention is to provide an improved plastic drain assembly which will save plumbers installation time and the need for large inventories, and which is light weight, non-corrosive and of long life in use.

Other objects and advantages of the invention will become apparent during the course of the following description.

In the drawings, I have shown one embodiment of the invention.

In this showing:

FIG. 1 is an elevational view of the assembled three part plastic drain assembly comprising the present invention;

FIG. 2 is a similar fragmentary view thereof illustrating the use of the basic plastic drain outlet of the three part assembly in connection with a larger drain pipe than shown in FIG. 1;

FIG. 3 is a vertical central sectional view of the three part plastic drain assembly in assembled relationship with a water proofing membrane locked in position by the clamping collar of the assembly;

Figure 5:
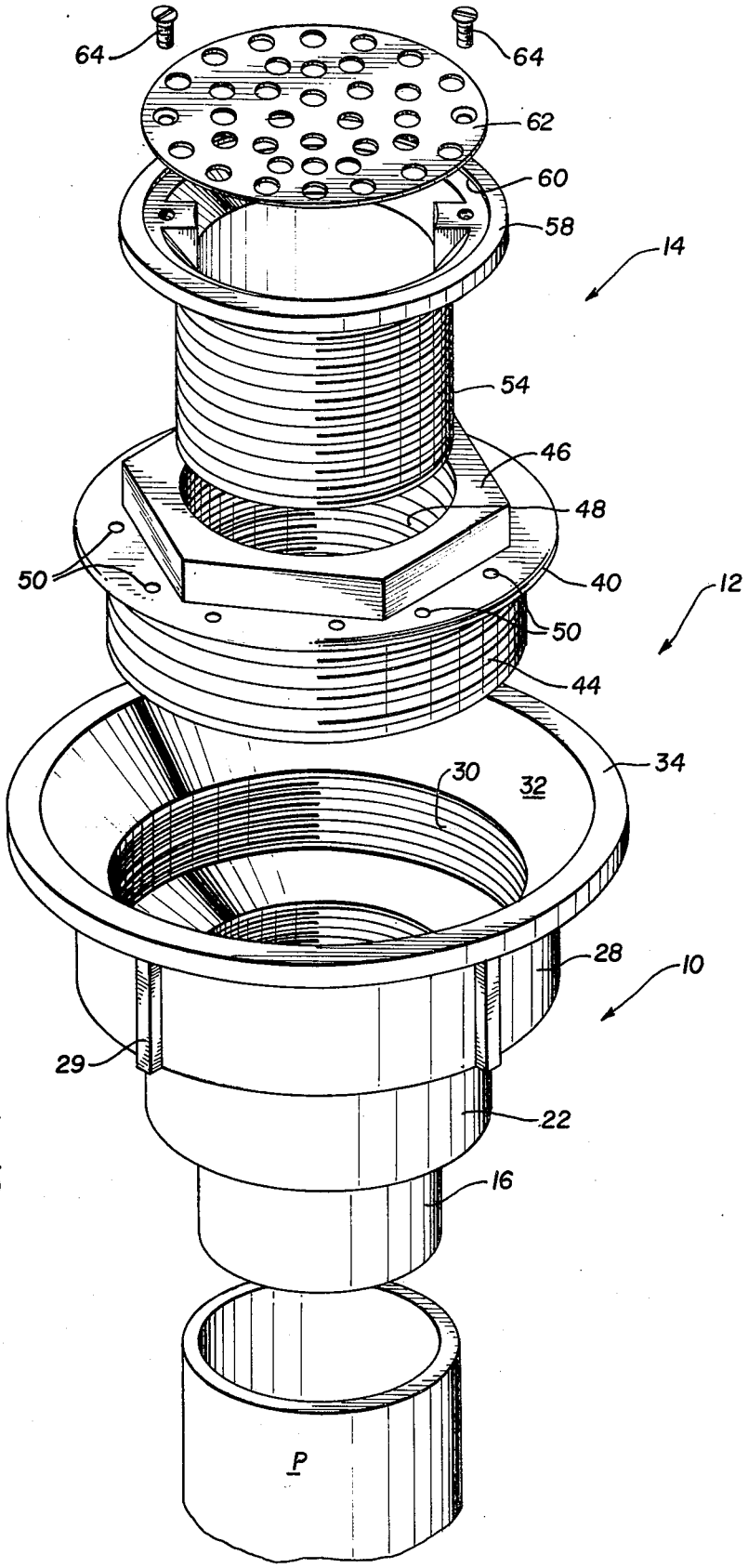

FIG. 4 is a vertical central sectional view of the invention wherein no water proofing membrane or clamping collar is used and only the stainless steel strainer drain plate supporting collar is used with the drain outlet; and FIG. 5 is an exploded perspective view of the three part plastic drain assembly showing the relationship of the drain outlet, the membrane clamping collar, and the strainer drain plate supporting collar.

Referring to the drawings, numerals 10, 12 and 14 respectively designate the plastic drain outlet, the plastic clamping collar and the plastic drain-plate-supporting collar as a whole, all combining to form a two or three part drain assembly as required by any given drain installation.

The plastic drain outlet 10 includes a lower drain pipe 16 terminating upwardly in a pair of inner and outer annular shoulders 18 and 20 respectively forming the lower end of a lower barrel section 22. The edges of the inner shoulders 18 incline upwardly and outwardly to a vertical threaded section 24 on the inner surface of the barrel 22.

The threaded section 24 terminates in the upwardly and outwardly inclined bottom 26 of an upper barrel section 28 which is of greater diameter than barrel section 22 and which is also threaded on its interior surface as at 30. At the upper end of the threads 30, the barrel 28 also inclines upwardly and outwardly at an angle of 45 degrees as at 32 and this beveled area terminates in a horizontal rim 34.

The clamping collar 12 is employed where grouting or other filler material is used (not shown) and a waterproof membrane 36 is used thereunder (FIG. 3) and extends over the peripheral rim sections 34, 32 of the drain outlet 10. The membrane 36 is clamped to the 45 degree angled rim portion 32 by the similarly inclined or beveled under face 38 of a peripheral flange 40 on the clamping collar 12 from which depends a barrel 42 which is externally threaded as at 44 and in threaded engagement with the upper barrel threads 30 of the drain outlet 10 which is provided with strengthening ribs 19 which also prevent turning of the installed section.

The clamping collar 12 is provided with a hexagonal nut 46 which is internally threaded as at 48 so that the threads 48 and 24 of the drain outlet 10 are in axial alignment. The plastic clamping collar 12 is also provided with a pair of spaced weep holes 50 adjacent each side of the nut 46 which holes cannot clog up because of rust thus providing against future loss of condensation drainage.

The drain plate supporting collar 14 comprises an open barrel 52 which is exteriorly threaded as at 54. The upper end of the barrel is outwardly inclined as at 56 and terminates in a horizontal rim 58 having a recess 60 for the reception of a stainless steel strainer drain plate 62 which is secured to the barrel 52 by a pair of screws 64.

It will be noted that the strainer drain plate 62 and its supporting barrel 52 may be vertically adjusted with respect to the clamping collar 12 by means of the threads 54, 48 (FIG. 3) and with respect to the drain outlet 10 by means of the threads 54, 24 (FIG. 4).

It is also to be noted that where the plastic drain outlet 10 is mounted on a system-drain pipe P of plastic, much installation time is saved by the plumber as the unit may simply be glued or solvent welded to the pipe P without the use of special adaptors and additional labor required in joining existing metal units to plastic pipe.

It is to be understood that the form of my invention herewith shown and described is to be taken as a preferred example of the same and that various changes in the shape, size and arrangement of parts may be resorted to without departure from the spirit of the invention or the scope of the subjoined claims.

What is claimed is:

1. A drain pipe assembly for the floor of showers, etc. comprising, in combination, an outlet section to be mounted on a system drain pipe; said outlet section having an upper rim section and upper and lower threaded inner faces of larger and smaller diameters respectively; a clamping collar having a peripheral rim section for engaging said outlet upper rim section and exterior threads engageable with said larger threaded inner face; said clamping collar having an inner face with threads axially aligned with said smaller diameter outlet threaded inner face; and a strainer drain plate supporting barrel having an exterior threaded face engageable with said clamping collar inner threads and with said smaller inner threaded outlet face.

2. The combination recited by claim 1 wherein said engaging rim sections are beveled to clamp a waterproof membrane therebetween without tearing it.

3. The combination recited in claim 1 wherein said clamping collar is provided with a plurality of spaced, vertical weep holes to permit condensation drainage therethrough.

4. The combination reciated in claim 1 wherein the outlet section includes a drain pipe having inner and outer shoulders for mounting on different sizes of system drain pipes.

5. The combination recited in claim 1 wherein said outlet section includes circumferentially spaced, radially projecting ribs to strengthen the same and to prevent rotary movement thereof when installed.

6. A drain pipe assembly for the floor of showers, etc. comprising, in combination, an outlet section to be mounted on a system drain pipe; said outlet section having an upper rim section and upper and lower threaded inner faces of larger and smaller diameters respectively; a clamping collar having a peripheral rim section for engaging said outlet upper rim section and exterior threads engageable with said larger threaded inner face; said clamping collar having an inner face with threads axially aligned with said smaller diameter outlet threaded inner face; and a strainer drain plate supporting barrel having an exterior threaded face engageable with said clamping collar inner threads.

7. A drain pipe assembly for the floor of showers, etc. comprising, in combination, an outlet section to be mounted on a system drain pipe; said outlet section having an upper rim section and upper and lower threaded inner faces of larger and smaller diameters respectively; a clamping collar having a peripheral rim section for engaging said outlet upper rim section and exterior threads engageable with said larger threaded inner face; said clamping collar having an inner face with threads axially aligned with said smaller diameter outlet threaded inner face; and a strainer drain plate supporting barrel having an exterior threaded face engageable with said smaller inner threaded outlet face.

* * * * *